US009997839B2

(12) United States Patent
Radi et al.

(10) Patent No.: US 9,997,839 B2
(45) Date of Patent: Jun. 12, 2018

(54) METAL PATTERN ON ELECTROMAGNETIC ABSORBER STRUCTURE

(71) Applicant: Wistron NeWeb Corp., Hsinchu (TW)

(72) Inventors: Babak Radi, Hsinchu (TW); Yuan-Chin Hsu, Hsinchu (TW); Yu-Fu Kuo, Hsinchu (TW); Tzu-Min Wu, Hsinchu (TW); Tzu-Wen Chuang, Hsinchu (TW); Shih-Hong Chen, Hsinchu (TW)

(73) Assignee: Wistron NeWeb Corp., Hsinchu (TW)

( * ) Notice: Subject to any disclaimer, the term of this patent is extended or adjusted under 35 U.S.C. 154(b) by 435 days.

(21) Appl. No.: 14/816,048

(22) Filed: Aug. 2, 2015

(65) Prior Publication Data

US 2016/0072192 A1 Mar. 10, 2016

(30) Foreign Application Priority Data

Sep. 5, 2014 (TW) ..... 103130786 A

(51) Int. Cl.
*H01Q 17/00* (2006.01)

(52) U.S. Cl.
CPC ..... *H01Q 17/004* (2013.01)

(58) Field of Classification Search
CPC ..... H01Q 17/004
USPC ..... 342/1
See application file for complete search history.

(56) References Cited

U.S. PATENT DOCUMENTS

2012/0055992 A1* 3/2012 Hsieh ..... G06K 7/10168 235/439

FOREIGN PATENT DOCUMENTS

| | | |
|---|---|---|
| JP | 2006245950 | 9/2006 |
| TW | M419240 | 12/2011 |
| TW | I410195 | 9/2013 |
| TW | 201414382 | 4/2014 |

OTHER PUBLICATIONS

"Office Action of Taiwan Counterpart Application," dated Jul. 4, 2016, p. 1-p. 8.
"Office Action of Taiwan Counterpart Application," dated May 31, 2017, p. 1-p. 4.

* cited by examiner

*Primary Examiner* — Timothy A Brainard
(74) *Attorney, Agent, or Firm* — JCIPRNET

(57) ABSTRACT

A metal pattern formed in the electromagnetic absorber structure is provided. By performing the laser treatment to form the active layer thereon, the metal pattern can be regionally formed on the electromagnetic absorber structure in the following electroless plating processes.

14 Claims, 3 Drawing Sheets

METAL PATTERN ON ELECTROMAGNETIC ABSORBER STRUCTURE

CROSS-REFERENCE TO RELATED APPLICATION

This application claims the priority benefit of Taiwan application serial no. 103130786, filed on Sep. 5, 2014. The entirety of the above-mentioned patent application is hereby incorporated by reference herein and made a part of this specification.

BACKGROUND OF THE INVENTION

Field of the Invention

The present invention is related to a metal pattern on a surface of an electromagnetic absorber structure.

Description of Related Art

Near field communication (NFC), also called short distance wireless communication, is a short distance high frequency wireless communication technology that allows non-contact point-to-point data transmission to be carried out between electronic devices and the data can be exchanged within the distance of 10 centimeters (3.9 inches). Since the NFC technology requires lower frequency, the corresponding antenna elements typically have a longer resonant path.

For the mobile devices, it is common to use the electromagnetic absorber material in an antenna structure for NFC. Generally, at least one layer of the electromagnetic absorber material is further attached to the antenna structure in order to avoid communal interference between an NFC antenna and other electronic devices and/or metal elements in the mobile device. In view of the miniaturization trend for the designs of communication field, it is necessary to consider further reducing the total thickness of the overall antenna structure, and such design has to be compatible with the manufacturing processes.

SUMMARY OF THE INVENTION

An electromagnetic absorber structure having a metal pattern thereon is provided in the present invention. The aforementioned metal pattern is formed by applying laser to a predetermined region on the electromagnetic absorber, followed by electroless plating the predetermined region in order to form the metal pattern on the electromagnetic absorber structure.

According to an embodiment of the present invention, the electromagnetic absorber structure includes an electromagnetic absorber layer and at least one insulative layer disposed on the surface of the electromagnetic absorber layer. The electromagnetic absorber structure has at least one predetermined region, and the insulative layer within the predetermined region does not cover the surface of the electromagnetic absorber layer. The metal pattern is disposed in the predetermined region of the electromagnetic absorber structure and is located on the surface of the electromagnetic absorber layer within the predetermined region.

According to another embodiment of the present invention, the electromagnetic absorber structure includes an electromagnetic absorber layer and at least one insulative layer disposed on the surface of the electromagnetic absorber layer, and the electromagnetic absorber structure has at least one predetermined region. An active layer is located on the surface of the electromagnetic absorber layer within the predetermined region. The metal pattern is located on the active layer of the surface of the electromagnetic absorber layer within the predetermined region.

According to the embodiments of the present invention, the material of the electromagnetic absorber layer may be manganese-zinc ferrite or nickel-zinc ferrite.

According to the embodiments of the present invention, the surface of the electromagnetic absorber layer within the predetermined region is treated with laser, thereby activating an active layer formed on the surface of the electromagnetic absorber layer and removing the insulative layer. The metal pattern is formed via an electroless plating process by using the active layer as a seed layer.

According to the embodiments of the present invention, the region of the electromagnetic absorber layer, where the metal pattern is to be formed, is activated first via the laser treatment, so that the metal pattern is ensured to be formed in the predetermined position during the following electroless plating process. By doing so, the formation of an unexpected metal layer that may depreciate the function or appearance can be avoided, thereby making the metal pattern to be formed more precisely.

In order to make the aforementioned features and advantages of the invention more comprehensible, embodiments accompanying figures are described in detail below.

DESCRIPTION OF EMBODIMENTS

A metal pattern directly formed on an electromagnetic absorber and a forming method thereof are provided. By using laser treatment, a predetermined region on the surface of the electromagnetic absorber is activated and an insulative layer within the predetermined region on the electromagnetic absorber will be removed accordingly. Thereafter, a metal pattern is formed in the predetermined region on the surface of the electromagnetic absorber by using an electroless plating process. The laser treatment is capable of either directly activating the predetermined region (predetermined pattern) on the surface of the electromagnetic absorber, or penetrating through a specific region of the electromagnetic absorber to form a through hole. No metal layer will be formed in the region not treated by the laser treatment during the subsequent electroless plating process. Thus, with such forming method, a metal pattern having a precise pattern (with precise border) can be formed in situ at the predetermined region on the surface of the electromagnetic absorber via the electroless plating process.

Here, the material of the electromagnetic absorber may be a high magnetic permeability material. Generally speaking, the electromagnetic absorber material can effectively absorb electromagnetic radiation and avoid magnetic field interference within a specific frequency range, thus eliminating electromagnetic or radio frequency interference caused by nearby electronic devices. The electromagnetic absorber material may be, for example, ferrite, which is majorly made of iron oxide. There are various kinds of ferrites, including manganese-zinc ferrite, nickel-zinc ferrite, etc. Nickel-zinc ferrite is more capable of absorbing frequencies greater than 1 MHz.

FIGS. 1A-1E are cross-sectional schematic views illustrating process steps for forming a metal pattern on an electromagnetic absorber structure according to an embodiment of the present invention.

Figure 1A:
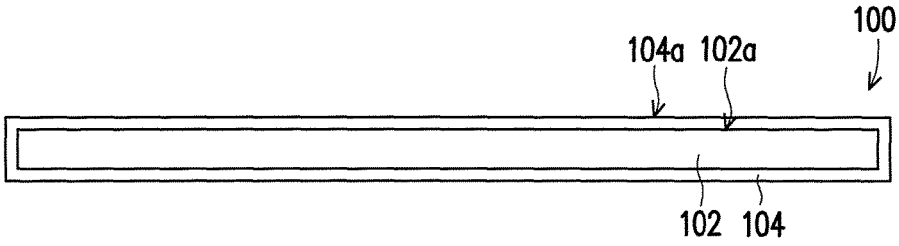
FIGS. 1A-1E are cross-sectional schematic views illustrating process steps for forming a metal pattern on an electromagnetic absorber structure according to an embodiment of the present invention.

Referring to FIG. 1A, an electromagnetic absorber structure 100 is provided, the electromagnetic absorber structure 100 has an electromagnetic absorber layer 102 and at least one insulative layer 104 covering the surface 102*a* of the electromagnetic absorber layer 102. The insulative layer 104 may be, for example, a stacked layer of a thermal-plastic material layer and an adhesive layer. The material of the thermal-plastic material layer may be, such as polyethylene terephthalate (PET). The thermal-plastic material layer can be attached to the electromagnetic absorber layer 102 via the adhesive layer, and the thickness of the PET/adhesive stacked layer is approximately 5-10 μm. The material of the electromagnetic absorber layer 102 may be manganese-zinc ferrite or nickel-zinc ferrite. The thickness of the electromagnetic absorber layer 102 is, for instance, between 0.045-0.3 mm.

Figure 1B:
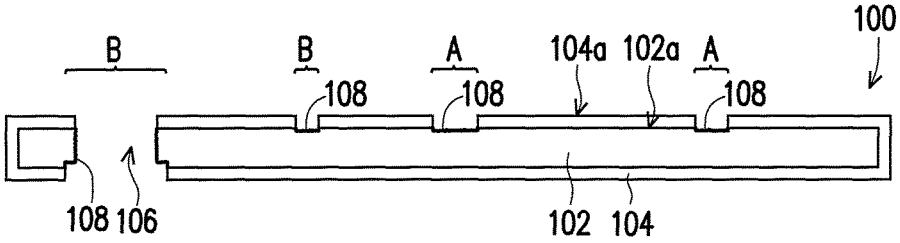

Referring to FIG. 1B, a laser treating step is performed to apply laser to predetermined regions A and B of the surface 104*a* of the insulative layer 104 for removing a part of the insulative layer 104 within the predetermined region A to expose the surface 102*a* of the electromagnetic absorber layer 102 underneath the insulative layer 104, and removing the insulative layer 104 within the predetermined region B and penetrating through the electromagnetic absorber layer 102 to form an through-hole 106. The surface of the electromagnetic absorber layer 102 overlapping with the predetermined regions A and B is not covered by the insulative layer 104.

Referring to FIG. 1B, nickel-zinc ferrite is used as an example as the material of the electromagnetic absorber in this embodiment. In the laser treating process, the laser will activate the exposed surface 102*a* of the electromagnetic absorber layer 102 within the treated regions (i.e., regions A & B) to form an active layer 108 on the surface 102*a* of the electromagnetic absorber layer 102 within the regions A & B. The activation mechanism relies on the reduction reaction caused by exposing to laser. The iron oxide contained in nickel-zinc ferrite is than being reduced into iron thereby constituting the active layer 108 being used as a seed layer in the subsequent electroless plating process. The active layer 108 is very thin, and the laser treated regions (i.e., regions A & B) are corresponded to the locations to be formed with conductive patterns. The laser treating step allows the location and shape of the subsequently formed pattern to be controlled precisely.

Accordingly, the laser treatment process may ensure the active layer 108 to be formed on the surface 102*a* of the electromagnetic absorber material within the predetermined region and used as a seed layer in the subsequent electroless plating process. The location of the active layer 108 corresponds to the location where the conductive pattern is to be formed subsequently, and a precise metal pattern will then be formed in the predetermined location during the subsequent electroless plating process. The aforementioned predetermined region A of the electromagnetic absorber structure 100 may be a region where an antenna is to be disposed, and the predetermined region B of the electromagnetic absorber structure 100 may be a region wherein a contacting or a connecting structure is to be disposed. The laser used in the laser treating step is, for example, infrared (IR) laser having a power of 8-10 W, at a frequency of 40-75 kHz, and a wavelength of 1064 nm.

Here, the active layer 108 is formed on the surface 102*a* of the electromagnetic absorber layer 102 within the regions A & B, and the region(s) not treated by the laser treatment is still covered by the insulative layer 104. Therefore the surface 102*a* in the untreated region(s) is isolated from the outer environment. As a result, in the electroless plating process performing subsequently, since the untreated region(s) (i.e., the non-predetermined region(s)) of the surface of the electromagnetic absorber structure 100 is isolated by the insulative layer 104, no plating reaction will occur between the non-predetermined region and the electroless plating solution.

After the laser treating step is performed, the electromagnetic absorber structure 100 is immersed into an electroless plating solution(s) for performing a series of electroless plating processes.

Figure 1C:
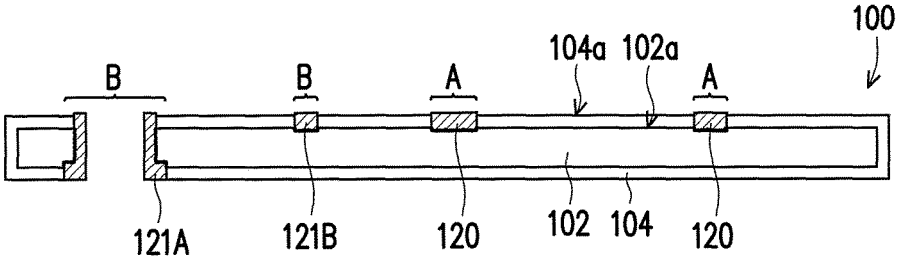

Referring to FIG. 1C, a first electroless plating process is conducted at the electromagnetic absorber structure 100. Since the active layer 108 is formed within the predetermined regions A & B that were treated with the laser treatment, metal patterns 120 and 121 are respectively formed on the active layer 108 in the predetermined regions A & B of the electromagnetic absorber structure 100 during the electroless plating process through the active layer 108. In this embodiment, the first electroless plating process utilizes the active layer 108 as a seed pattern for electroless plating, and therefore the metal pattern 120 can be precisely formed on the distributed range of the active layer 108 within the predetermined region A. Likewise, metal patterns 121A and 121B are precisely formed over the distributed range of the active layer 108 within the predetermined region B (including portions of the surface 102*a* of the electromagnetic absorber layer 102 and the inner surface of the through-hole 106). Actually, the metal pattern 121A should be a through-hole conductive structure which fully covers the inner sidewall of the through-hole 106, and the metal pattern 121B is a contact pad. Here, the first electroless plating process is exemplified by a copper electroless plating process. The formed metal pattern 120 is, for example, a copper pattern having a thickness of not thicker than 60 μm and a surface thereof being slightly higher than the surface 104*a* of the insulative layer 104. The metal pattern 121A may be a copper plug, and the metal pattern 121B may be a copper contact pad. In this embodiment, the metal pattern 120 may be a continuous pattern or non-continuous patterns; and the metal pattern 120 may be, for example, a metal antenna structure. No plating occurs in the portions (i.e., regions other than the regions A & B) which are covered by the insulative layer 104.

In fact, the surface of the metal pattern 120 is slightly higher than the surface 104*a* of the insulative layer 104, and therefore the metal pattern 120 may be seen as being partially inlaid in the electromagnetic absorber structure 100. Accordingly, in the present invention, the metal pattern is directly embedded in the electromagnetic absorber structure 100, which may further reduce the entire thickness of the metal pattern or metal antenna structure. Hence, the entire structure can be much more suitable to be integrated in mobile communication electronic devices such as cell phones, tablet PCs or wireless high frequency communication devices and the like.

By applying laser, the obtained metal pattern may form a high precision profile. Moreover, since the scanning of the laser can be easily adapted to the shape or profile of the electromagnetic absorber structure, the metal pattern may be precisely formed on a planar surface or an uneven object.

Figure 1D:
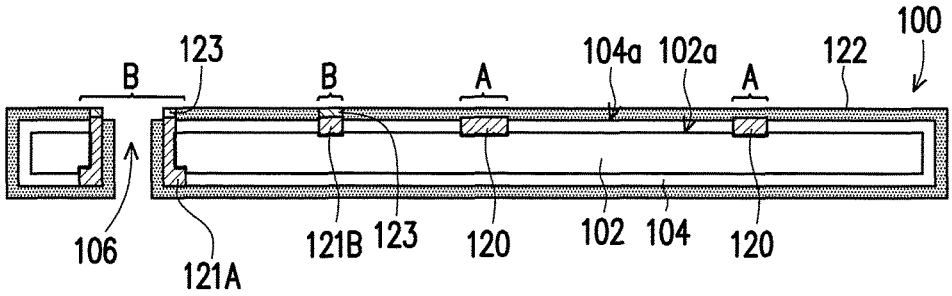
Figure 1E:
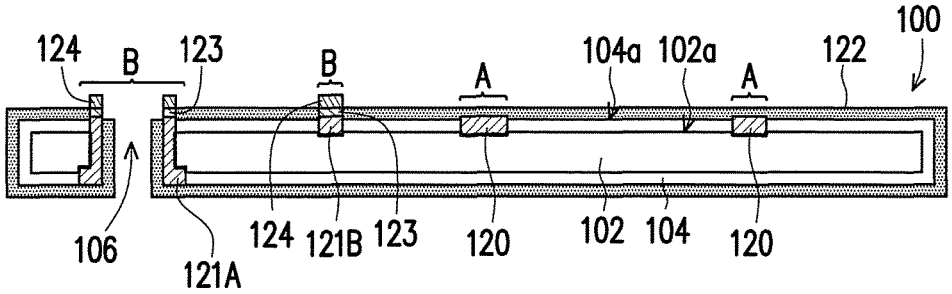

Referring to FIGS. 1D-1E, an organic protecting layer 122 is formed covering the electromagnetic absorber structure 100. The organic protecting layer 122 covers the metal pattern 120 formed in the predetermined region A, whereas the layer 122 does not cover the metal patterns 121A and 121B formed in the predetermined region B. Thereafter, a second electroless plating process and a third electroless plating process are performed in sequence. A metal layer 123 and a metal layer 124 are sequentially formed on the metal patterns 121A and 121B within the predetermined region B of the electromagnetic absorber structure 100. Here, the first electroless plating process is exemplified by a copper electroless plating process. The second electroless plating process and the third electroless plating process are respectively exemplified by a nickel electroless plating process and a gold electroless plating process. The metal layers 123/124 may be, for example, a nickel layer, and a gold layer, respectively.

In the embodiment, the metal pattern may be, for example, an antenna pattern of a single conductive layer and a contact pad having multiple conductive layers. Firstly, a copper (layer) pattern having good conductivity is formed on an electromagnetic absorber material. Then, an organic protecting layer or a nickel layer and a gold layer is formed on the copper pattern in order to reduce oxidization of the copper layer. The metal pattern may be used as an antenna, a connecting terminal or other metal components. The material of the metal pattern includes copper, nickel, gold, silver or any combinations of the above elements.

In this embodiment, a stacked-layer structure is composed by the metal pattern 120/the organic protecting layer 122 formed in the predetermined region A of the electromagnetic absorber structure 100. The stacked-layer structure at least includes a metal antenna structure (i.e., the metal pattern 120), and the electromagnetic absorber layer 102 underneath may effectively absorb electromagnetic radiation and magnetic field interference, which may avoid electromagnetic interference or radio frequency interference interfering the antenna structure caused by other electronic devices.

Figure 2:
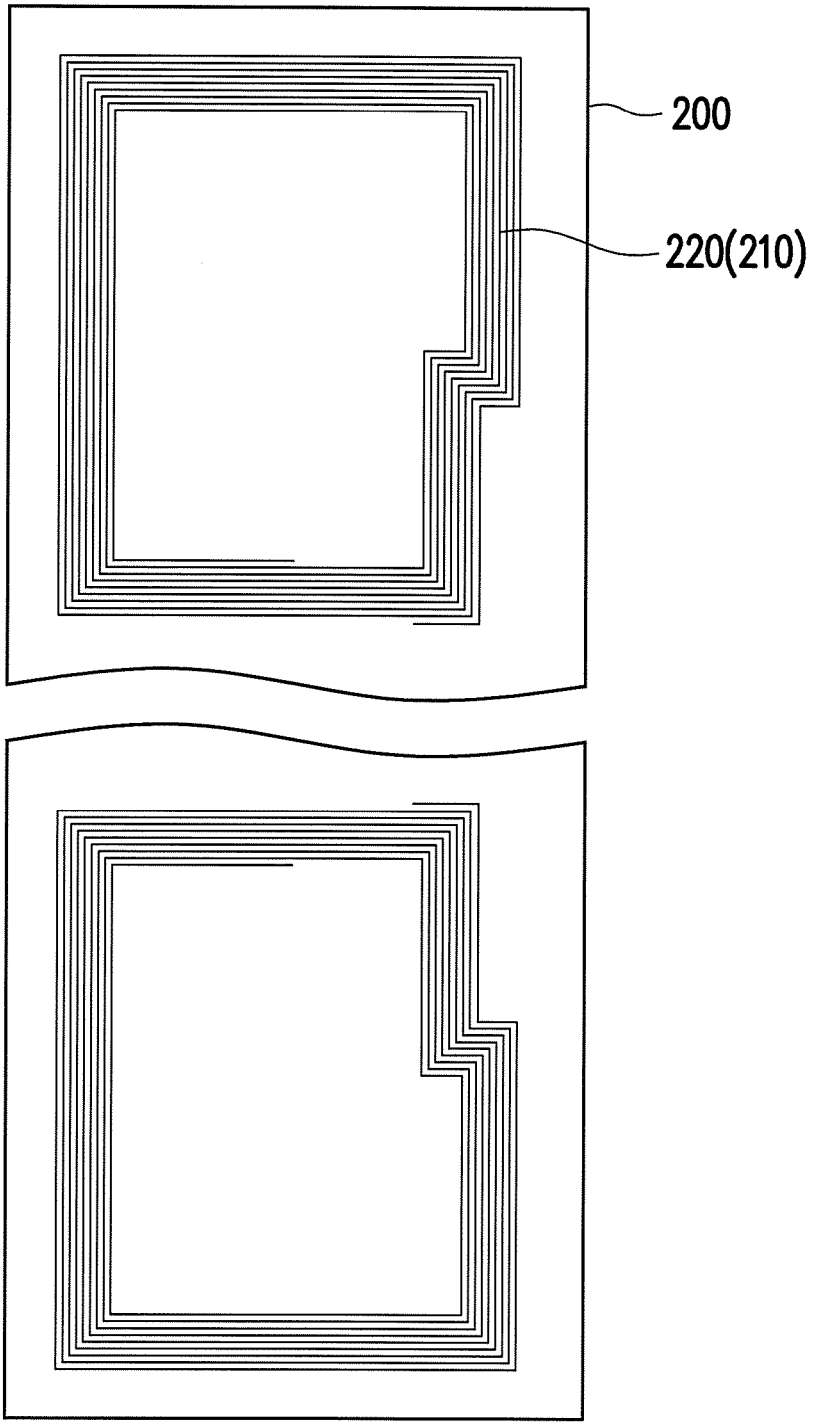
FIG. 2 is a top view illustrating a metal pattern formed on an electromagnetic absorber structure according to an embodiment of the present invention.

FIG. 2 is a top view illustrating a metal pattern formed on an electromagnetic absorber structure according to an embodiment of the present invention. FIG. 2 is only partially showing of the metal pattern 210 formed on an electromagnetic absorber structure 200, and the figure is mainly to show a metal antenna structure 220 of the metal pattern 210. FIG. 2 shows that the metal antenna structure 220 (pattern) is designed as an annular antenna, and the annular antenna may be, for example, an annular rectangle with a dimension of 4 cm×5 cm or of other suitable sizes. Certainly, the antenna may be in an annular shape or any other geometric shapes. In the embodiment, the metal antenna structure 220 may be a magneto-inductive antenna or a near-field communication (NFC) antenna. The level of the magnetic flux needs to be taken into consideration while designing the sizes and shapes of the magneto-inductive antenna. In order to prevent interferences to the metal antenna structure, in this embodiment, the size of the electromagnetic absorber structure 200 is designed to be greater than the metal antenna structure 220. The total thickness of the metal antenna structure 210 may be smaller than approximately 500 μm. A thinner metal antenna structure is suitable to be used with a flexible substrate, and can be applied to the peripheral appliances of mobile devices. In this embodiment, the thickness of the metal antenna structure can be 100-500 μm.

The electromagnetic absorber structure 200 is similar to the electromagnetic absorber structure 100 described in the above embodiment (see FIG. 1A), which at least has one electromagnetic absorber layer and at least one insulative layer covering the surface of the electromagnetic absorber layer. Here, the following descriptions may be clearly understood by referring to the above embodiment. The metal pattern 210 (including the metal antenna structure 220 as well) is directly formed on the electromagnetic absorber structure 200. In fact, the metal pattern 210 and the metal antenna structure 220 may even be partially inlaid in the electromagnetic absorber structure 200. While comparing with conventional designs which use a portion of a flexible printed circuit as an antenna which is also being printed on a substrate, in the present invention, the metal antenna pattern is directly embedded in the electromagnetic absorber structure 200, which may further reduce the entire thickness of the structure having the electromagnetic absorber material and the metal pattern or the metal antenna.

In the aforementioned embodiments, the metal pattern may be formed on the electromagnetic absorber material by electroless plating, and the metal pattern may be, for example, an antenna including a single-layered copper pattern. However, the metal pattern may also include multi-layered conductive patterns. The metal pattern may be used as an antenna, a connector or other metal components. The material of the metal pattern includes copper, nickel, gold, silver or any combination of the above elements.

More specifically, since the material of the metal antenna structure 220 is mainly made of metals which might be easily interfered by kinds of interferences, the electromagnetic absorber material disposed underneath the metal antenna structure 220 may absorb and reduce magnetic or radio frequency interferences caused by other metal components or other electronic devices. Hence, the performance of the antenna will not be adversely affected and can be enhanced.

The metal pattern formed in the electromagnetic absorber structure provided in the present invention is also fully applicable to slim antennas commonly used in the communication industry.

In the aforementioned embodiments, the metal pattern structure formed in the electromagnetic absorber material may be further attached to a portable device, such as a case of a cell phone or a circuit board through other fixing means.

Specifically, the electromagnetic absorber material may be immersed into an electroless plating solution to form the metal pattern. Because the laser treatment is performed to activate the region where the metal pattern is to be formed prior to the subsequent plating processes, the metal pattern can be precisely formed in that predetermined location during the electroless plating process. In addition, because the process set forth in the present invention does not employ any screen printing, pad printing, or transfer printing, etc., to form the metal pattern, there is no need for photo-masks, developers or inks.

Although the invention has been disclosed by the above embodiments, the embodiments are not intended to limit the invention. It will be apparent to those skilled in the art that various modifications and variations can be made to the structure of the invention without departing from the scope or spirit of the invention. Therefore, the protecting range of the invention falls in the appended claims.

What is claimed is:

1. An electromagnetic absorber structure having a metal pattern, the electromagnetic absorber structure comprising:

an electromagnetic absorber layer disposed in the electromagnetic absorber structure;

at least an insulative layer covering the surface of the electromagnetic absorber layer, wherein the electromagnetic absorber structure has at least a predetermined region, and the surface of the electromagnetic absorber layer overlapping with the predetermined region is not covered by the insulative layer; and the metal pattern located within the predetermined region and on the surface of the electromagnetic absorber layer of the electromagnetic absorber structure.

2. The electromagnetic absorber structure according to claim 1, wherein the insulative layer is a stack of a polyethylene terephthalate layer and an adhesive layer.

3. The electromagnetic absorber structure according to claim 1, wherein the material of the electromagnetic absorber layer is manganese-zinc ferrite or nickel-zinc ferrite.

4. The electromagnetic absorber structure according to claim 3, wherein the metal pattern further comprises an antenna structure.

5. The electromagnetic absorber structure according to claim 4, wherein the material of the antenna structure comprises copper, nickel, gold, silver or a combination thereof.

6. The electromagnetic absorber structure according to claim 4, wherein the metal pattern comprises at least a contact pad or a metal thorough hole.

7. The electromagnetic absorber structure according to claim 6, wherein the contact pad is a copper pad covered by a nickel layer and a gold layer.

8. An electromagnetic absorber structure having a metal pattern, the electromagnetic absorber structure comprising:

an electromagnetic absorber layer disposed in the electromagnetic absorber structure;

at least an insulative layer covering the surface of the electromagnetic absorber layer, wherein the electromagnetic absorber structure has at least a predetermined region, and the surface of the electromagnetic absorber layer overlapping with the predetermined region has an active layer; and the metal pattern directly disposed on the active layer of the surface of the electromagnetic absorber layer in the predetermined region.

9. The electromagnetic absorber structure according to claim 8, wherein the material of the electromagnetic absorber layer is manganese-zinc ferrite or nickel-zinc ferrite.

10. The electromagnetic absorber structure according to claim 9, wherein the surface of the electromagnetic absorber layer overlapping with the predetermined region is treated by laser, thereby activating the surface of the electromagnetic absorber layer to form the active layer.

11. The electromagnetic absorber structure according to claim 10, wherein the metal pattern is formed by using the active layer as a seed layer via an electroless plating process.

12. The electromagnetic absorber structure according to claim 11, wherein the metal pattern further comprises an antenna structure, and the material of the antenna structure comprises copper, nickel, gold, silver or a combination thereof.

13. The electromagnetic absorber structure according to claim 11, wherein the metal pattern comprises at least a contact pad or a metal thorough hole.

14. The electromagnetic absorber structure according to claim 13, wherein the contact pad is a copper pad covered by a nickel layer and a gold layer.

* * * * *